US006103985A

United States Patent [19]

Shell et al.

[11] Patent Number: 6,103,985

[45] Date of Patent: Aug. 15, 2000

[54] TURN AROUND LOOP APPARATUS FOR DOCUMENT SCANNING/PROCESSING

[75] Inventors: Ronald G. Shell, Bloomfield Hills; William F. Battle, Canton; David J. Concannon, Lakeland, all of Mich.

[73] Assignee: Unisys Corporation, Blue Bell, Pa.

[21] Appl. No.: 09/040,195

[22] Filed: Mar. 10, 1998

Related U.S. Application Data

[60] Provisional application No. 60/054,679, Aug. 4, 1997.

[51] Int. Cl.[7] ..... B07C 5/00

[52] U.S. Cl. ..... 209/587; 209/540; 209/939; 271/186

[58] Field of Search ..... 271/186; 209/569, 209/576, 577, 583, 587, 540, 545, 939

[56] References Cited

U.S. PATENT DOCUMENTS

| | | | |
|---|---|---|---|
| 4,304,485 | 12/1981 | Povio | 271/186 |
| 4,358,016 | 11/1982 | Richardson et al. | 209/583 |
| 4,453,841 | 6/1984 | Bobick et al. | 271/186 |
| 4,456,237 | 6/1984 | Buddendeck | 271/186 |
| 4,677,682 | 6/1987 | Miyagawa et al. | 382/7 |
| 4,693,464 | 9/1987 | Honma | 271/265 |
| 4,722,444 | 2/1988 | Murphy et al. | 209/583 |
| 4,792,132 | 12/1988 | Jahme | 271/186 |
| 4,913,295 | 4/1990 | Murphy et al. | 209/583 |
| 4,916,493 | 4/1990 | DeVito | 271/186 |
| 5,115,918 | 5/1992 | DeWitt et al. | 209/545 |
| 5,150,167 | 9/1992 | Gonda et al. | 271/186 |
| 5,421,443 | 6/1995 | Hatamachi et al. | 194/206 |

FOREIGN PATENT DOCUMENTS

| | | |
|---|---|---|
| 0 609 937 A2 | 1/1994 | European Pat. Off. . |
| WO 95/24691 | 9/1995 | WIPO . |

*Primary Examiner*—Christopher P. Ellis
*Assistant Examiner*—Joe Dillon, Jr.
*Attorney, Agent, or Firm*—Mark T. Starr; Rocco L. Adornato; David G. Rasmussen

[57] ABSTRACT

This invention is a sheet processing array having an imaging station, an in-site, an exit-site and a transport array connecting all of them. The transport array is adapted to advance sheets from the in-site, past the imaging station for imaging the first face of the sheet and to advance it to a reversing transport section. This section has a series of rollers arrayed in a loop which continually rotate in one direction and are adapted to provide non-stop forward movement that turns the sheet over and returns it to present its opposite face to the imaging station for imaging. The sheet is then advanced to the exit-site.

11 Claims, 15 Drawing Sheets

TURN AROUND LOOP APPARATUS FOR DOCUMENT SCANNING/PROCESSING

This is a Continuation of my U.S. Provisional Application Ser. No. 60/054,679 filed Aug. 4, 1997 and claims priority therefrom.

FIELD OF INVENTION

This relates to check-scanner-processing machines and particularly to size-reduction and simplification thereof.

BACKGROUND FEATURES

This invention is directed to a Teller Scanner business machine that transports bank checks along a path within the machine whereby to perform various functional operations on these checks. This Teller Scanner here is reduced in size and footprint (vs. like machines), so as to conveniently fit in a limited space such as on a shelf near a bank teller window or in a retail clerk point of sale) cash register area.

Purposes

A salient purpose is to provide check processing institutions, such as banks and retail sales companies, with a machine that will scan the front and back sides of checks etc. and will generate digital images of each side, as well as read magnetic or optical characters encoded on the checks. Preferably, such a machine will also print an endorsement on the checks and sort the checks into bins. The machine preferably also has an input feeder to automatically feed the checks, one at a time, into the machine. (See FIG. 1 for a preferred embodiment).

FIG. 2 suggests a more conventional arrangement for imaging and otherwise processing both sides of a document: assumed inserted via Entry Bin 1 (with paper holder 2) to be transported along a U-shaped Track T-1 past a magnetic Read Head 3, an optical read head 5 a print head 8, a pair of document stamp-stations (Upper 9, lower 10) and a pair of upper/lower (i.e. Front, Rear) imaging scanners (11 for top Front side, 12 for rear side) to end up in either of two recovery bins A,B directed there by a sort-gate 13—as workers will understand. Of course this array could be disposed along a more rectilinear track, but the U-shape yields a more compact manageable unit—as workers will appreciate.

As explained below, one object hereof is to dispense with separate image stations for the top and bottom faces of a passing document—e.g. running the document-top past the image station, then the document-bottom, thus simplifying the machine, making it smaller and less expensive (embodiment M-1 does this; see FIG. 1).

But this presents the problem of quickly and efficiently "flipping" documents to do this. We resolve this problem with a novel "turn-over loop" (e.g. see M-1 in FIG. 1 and loop-unit T-oL which for instance, takes a document which has passed imaging station IS with its top exposed thereto, then flips it (turns it over) and returns it to station IS with its rear face turned up and exposed to IS, as particularized below.

What Is New Or Different

There are certain salient novel features of such machine, such as:

A. CHECK PATH: the design of the check path within the machine allows both the front and back side of a check to be imaged by a single Image Camera (and endorsed by a single endorse ISCC ER, FIG. 1—Front Endorser EF is optional here).

B. SMALL SIZE: the size and foot print of the machine is reduced so that it will occupy minimal shelf-space at a bank teller's window or retail clerk's counter.

Additionally, this machine, in its totality, will be understood as a possible key element for a novel Bank Check Processing System.

Advantages

A. CHECK PATH: A more conventional machine configuration is suggested in FIG. 2, with a check path that requires two Image Cameras in the machine to allow imaging of both the front and back side of a check.

By contrast, our invention presents a check path with a "turn-over loop" (see T-oL FIG. 1) that allows a single Image Camera IS to image both the front and back side of a check. This is accomplished in a transport providing a check path that directs the front side of the check past the Image Camera, then around the "turn-around loop" to reverse its direction, flip it over and then direct the back side of the check past the same Image Camera. This should reduce cost and enhance reliability (since the most expensive device in this type machine is the Image Camera) and simplify bit flow with associated electronics. Providing front and rear imaging functionality with one camera (vs. two cameras with associated electronics) is a big cost advantage; and can improve reliability (fewer parts to fail).

NOTE: The "turn-around loop" in this invention preferably is provided by three driven track rollers (with associated pinch rollers) arranged to provide a track perimeter slightly greater than the maximum-length check and to provide a rectilinear track section to present the front and then the back side, of a check at the imager station. Similarly, loop T-oL can also so present a check's reverse face to Rear Endorser, etc.

Other embodiments of such a turn-around loop would use one, two, four or more track rollers (and associated pinch rollers) or belts. These embodiments would change the appearance of Teller Window Scanner, but would not change the basic function of the transport and associated turn-around loop; i.e., present the front, then the back side of a check to a common Image Camera etc. FIG. 3 depicts a single track roller (drum) to execute a turn-around loop T-oL in a related embodiment M-3.

B. REDUCED SIZE: A more conventional machine (e.g. as in FIG. 2) would have a machine "footprint" of 79 square inches or more and a machine height of 8.9 inches or more. When processing 6 inch long checks, the footprint grows to approximately 106 square inches since a portion of the 6 inch check will overhang the machine. This is a relatively large, bulky machine, inapt to fit on a teller's window or in a retail sales cash register area.

By contrast, this invention's footprint is can be about 86 square inches (13% less) with a machine height of 8.5 inches (FIG. 1). The footprint grows to about 96 square inches when processing 6 inch checks; a 9% reduction vs. more conventional design, along with a 4% height reduction. This advantage amounts to taking up less space on a typically crowded teller/clerk counter top. This reduced size/footprint is achieved primarily by the following design features:

a. Only one Image Camera (as noted above), for Front and Rear imaging. Reduced electronics by off loading functionality to the clients host computer, and processing Front and Rear image data serially (rather than in parallel).

b. Two-direction track rollers for both approaches to the Image Camera;

c. Miniature, document driven Gates at the two-direction track rollers;

d. Power supply external to the machine; and

NOTE: The orientation of our preferred machine is such that check motion is mostly vertical. This orientation has the advantage of gravity-assist for urging the check down against a registration surface in the machine as it travels along the transport track. Registration surface; See FIG. 1A (which is an End View of FIG. 1) for the "registration surface". The registration surface is the surface in the baseplate where the bottom edge of the checks are to be against. You can see in FIG. 1A how gravity will tend to keep the check down against the registration surface. Skewed track pinch roller: See FIG. 3A (which is a partial End View of FIG. 3). In this embodiment you do NOT have gravity tending to keep the check against the registration surface. To compensate for this loss of gravity assist; the machine is designed to have the track pinch rollers skewed (approximately 4 degrees) to gently drive or steer the checks down against the registration track. There are several track pinch rollers along the path of the check in the machine.

Other embodiments of such a Teller Scanner machine can have the check moving mostly horizontally. These embodiments (e.g. FIGS. 3–6) have the advantage of further reducing the machine footprint. Loss of the gravity assist feature (in the "vertical machine") is off-set by incorporating a skewed-track pinch roller (e.g. see FIG. 3A) to drive the checks against a registration surface (e.g. as FIG. 1A). Gravity in these embodiments can assist check stacking in the sort Bins.

This further reduction in machine footprint is accomplished by designing the machine so that its two outside dimensions are minimized and made to constitute its width and depth (footprint=width×depth), leaving the third and longest outside dimension as machine height—as a further feature. Three other such embodiments can have the following footprint/height:

| | Footprint: machine | Footprint w/6" check | Height | See FIG. |
|---|---|---|---|---|
| a. Right Side Feeder/Bins | 77 sq. in. | 94 sq. in. | 9.3 in. | 4 |
| b. Top Load Feeder | 64 sq. in. | 108 sq. in. | 11.5 in. | 5 |
| In a more basic machine without a feeder or two bins: | | | | |
| c. Manual Feed/no Bins | 43 sq. in. | 93 sq. in. | 9.0 in. | 6 |

Thus, an object hereof is to provide such machines with reduced size (smaller footprint). Another object is to do so by making the checks execute a novel transport path (e.g. turn-around loop).

Another object hereof is to address at least some of the foregoing problems and to provide at least some of the mentioned, and other, advantages and features.

BRIEF DESCRIPTION OF THE DRAWINGS

These and other features and advantages of the present invention will be appreciated by workers as they become better understood by references to the following detailed description of the present preferred embodiments, which should be considered in conjunction with the accompanying drawings, wherein like reference symbols denote like elements.

FIG. 3-B the exterior thereof;

The methods and means discussed herein, will generally be understood as constructed and operating as presently known in the art, except where otherwise specified; likewise all materials, methods, devices and apparatus described herein will be understood as implemented by known expedients according to present good practice.

Background Details

Figure 2:
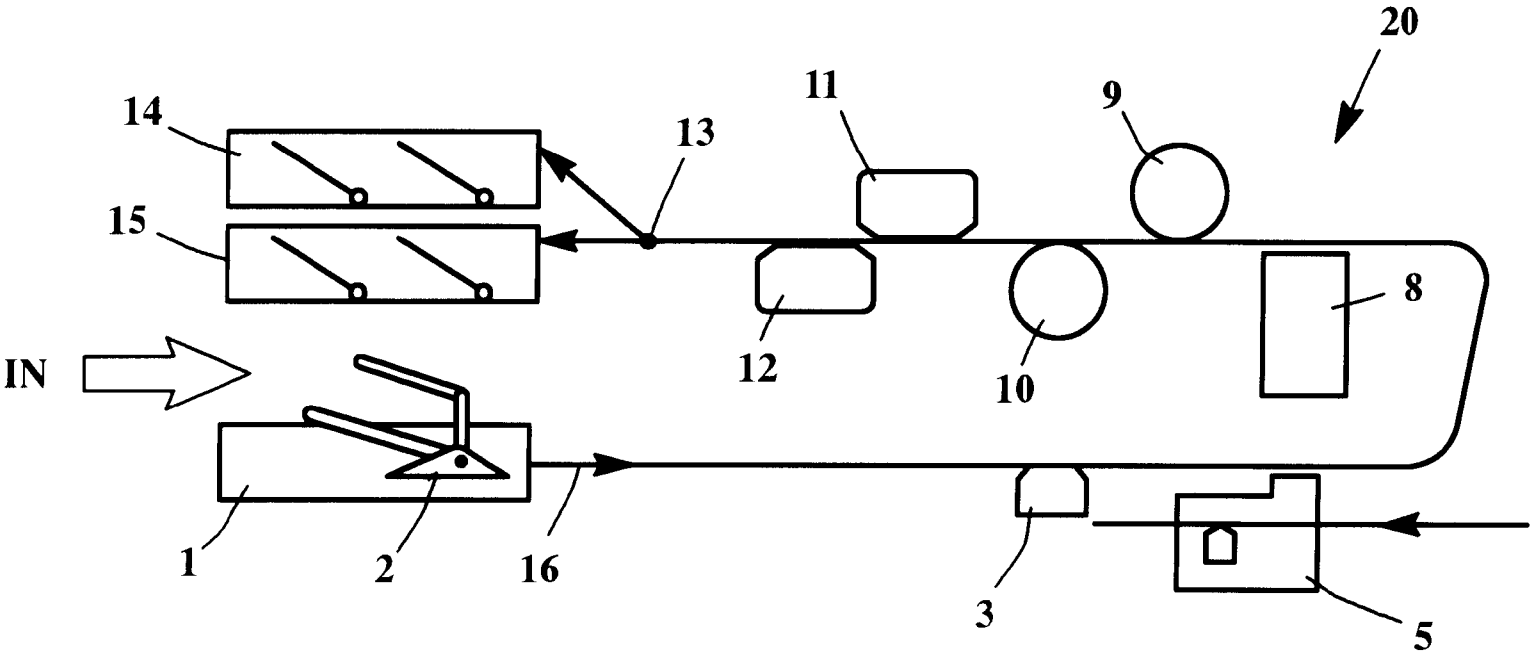
Prior Art Figure 2
FIG. 2—a comparable, more conventional layout; M-2.

As suggested above, FIG. 2 is intended to suggest a more conventional scanner layout whereby documents (e.g. checks) are input at the IN end of a transport track T-1 (see input bin 1, with document holder 2), being sent to a MICR Reader 3, then to a print station 8, then to Front-stamp station 9, or a Rear-stamp station 10, then to a Front image scan station 11 and then a Rear image scan station 12, and finally to out-store bins (e.g. 14, 15) via a bin-select gate 13. This happens to be a U-shaped track (for compactness), but in any event is relatively rectilinear and one-directional with monofunctional process stations spaced therealong, and Rear-operations disposed on one side of Track T-1 but Front-operations placed on the opposite side, and no bifunctional stations, e.g. operating on both document faces.

By contrast, my invention can eliminate certain stations (e.g. use only one imager) since it advances documents in one direction for operation on one (e.g. top) document-face, and then flips it over and returns the document past the same station, with its opposite face presented (e.g. for Rear-imaging).

DESCRIPTION OF PREFERRED EMBODIMENTS

Figure 1:
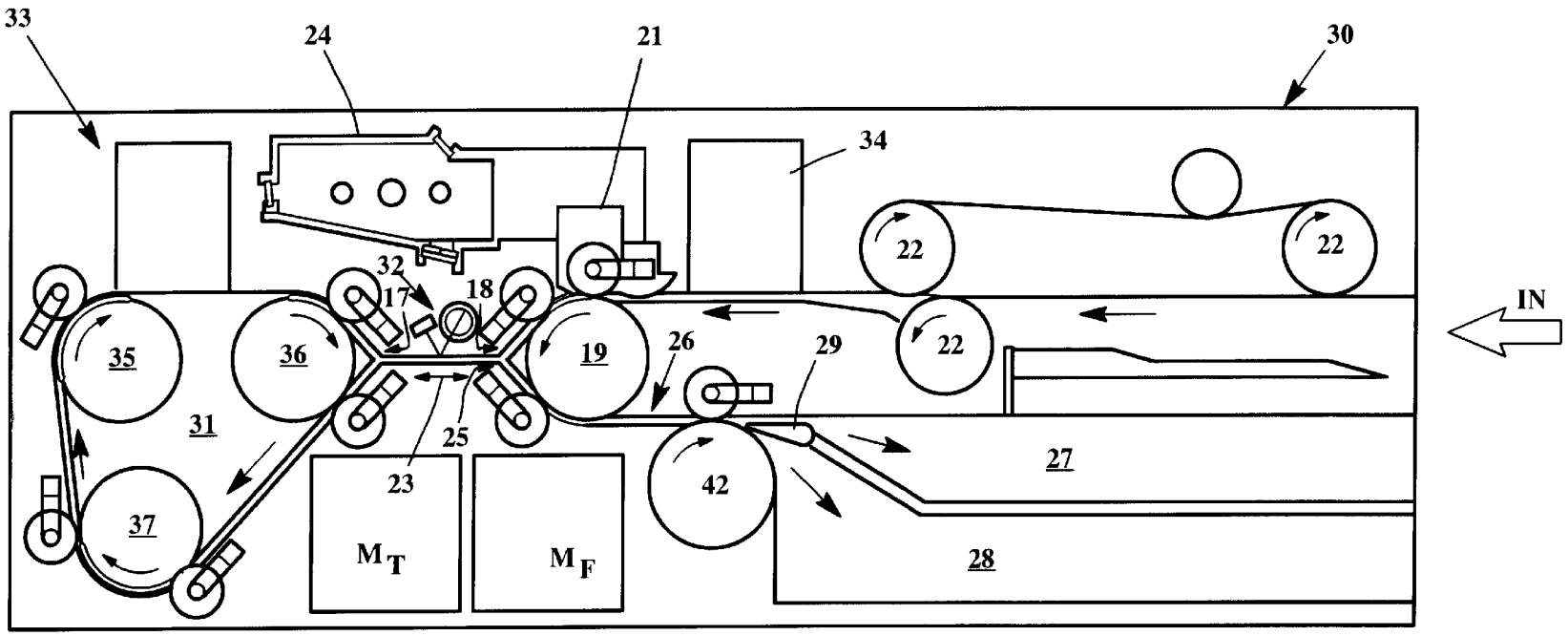
FIG. 1—a plan, view schematic of a favored Teller Scanner Transport Layout, embodiment M-1 of this invention.

FIG. 1 lays out elements along a preferred check path for a preferred check processing machine M-1 (Teller Scanner of reduced size: e.g. 14.6" wide, 8.5" high, 5.9" deep). Workers will understand that a check is introduced (at IN arrow) to be engaged by a transport ("Auto Feeder") to be driven past MICR (magnetic ink character reader) station; then past an imaging site IS (see "image" arrow) along rectilinear track segment T-15 where suitable illumination is directed onto one (front) side and the image thereof is directed optically to an imaging camera IC—all as generally understood in the art.

Next, the check is "turned about" (see "turn-over-loop" T-oL) to return and present its opposite (rear) face for processing (e.g. by Rear Endorser ER, then back to the imaging site IS, along T-15, to let the same camera IC make an image of its rear face. Thereafter, the check diverted by gate $G_1$ transported along an exit-path to one or more storage bins (e.g. see Bin 1, Bin 2; gate $G_2$ selects Bin). An optimizing feature is that, for this, a pair of switch points SP-1, SP-2 accommodate advancement -IN and -OUT by a common roller (i.e. -IN via SP-1 by roller R-1; then -OUT later; and similarly -IN by roller R-2, past switch SP-2, and later -OUT past SP-2 by roller R-2, again). Front Endorser EF may optionally be included.

Note switch points SP-1, SP-2 are document-driven gates.

Note rollers R-1, R-2 advance a check in two different directions, though they (rollers) are rotated unidirectionally.

Endorsers

Typically the Endorsement must be printed on the check BEFORE the image is taken (at least in many currently known applications). Thus one cannot do this with a single Endorser in T-IS.

Also, in many applications, what is Endorsed on the rear side of the check is based on what is read off the check at the MICR station. This requires the Rear Endorser to be after the MICR station (by an amount at least as much as the length of the longest check; 9.25") but before the Image station. To do this in T-IS would make the track length much longer and the footprint much bigger.

In our Teller Scanner we have determined that there is limited market for a Stamp Endorser, so we are offering a rear Endorser ER, Ink Jet type) only. This would be equivalent to the unit InkJet Print Head in FIG. 2.

Figure 1A:
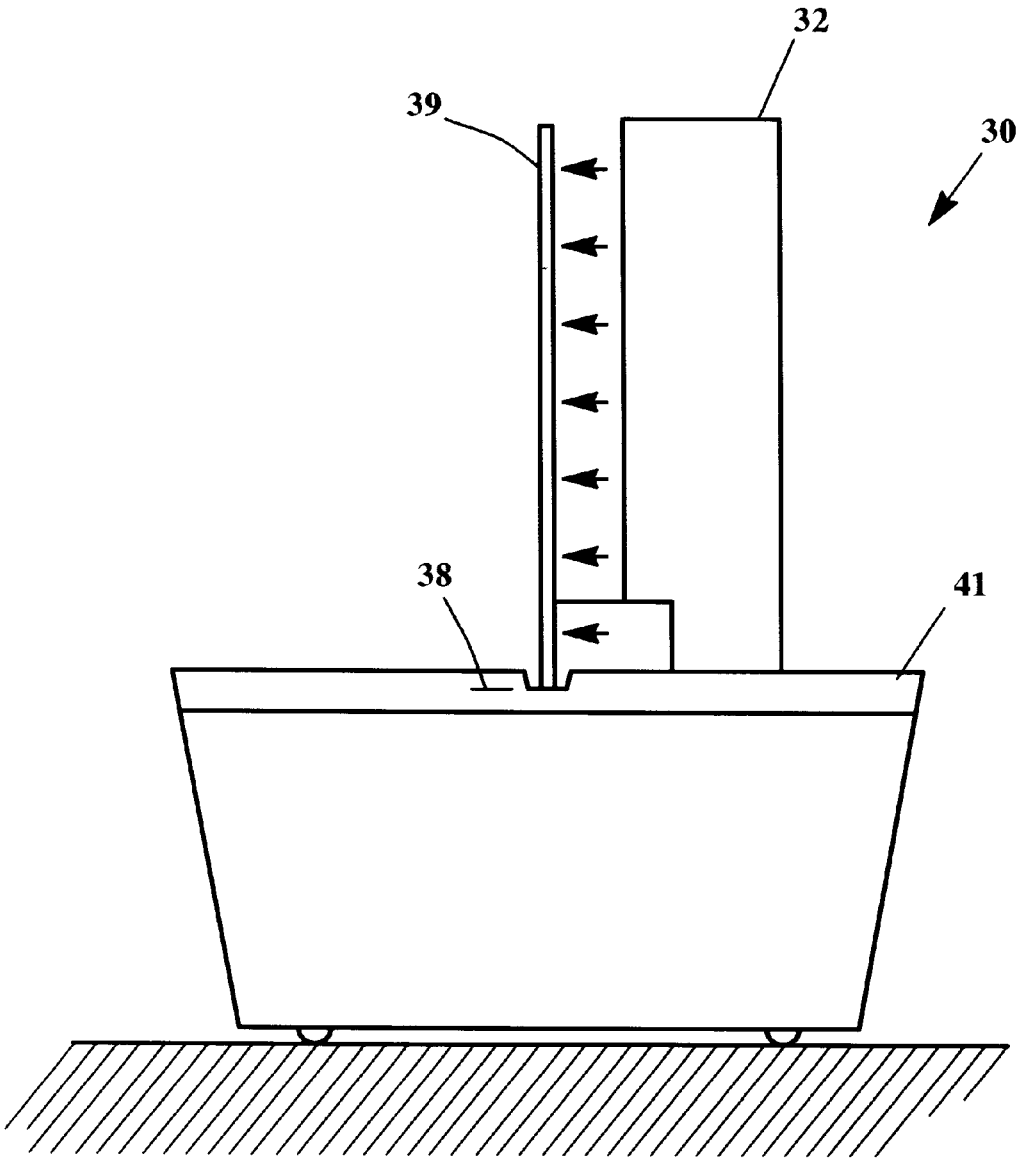
FIG. 1A, an end view thereof, and FIG. 1B with machine skins thereon.

FIG. 1A gives a very schematic end view of machine M-1 in FIG. 1, showing a check ch "on end" (and vertical) resting on a track, or registration surface r-s located on a baseplate 1-BP (assume under plane of FIG. 1) located on the bottom casing of machine M-1 (adapted to rest on a counter or table top). As noted check ch is gravity-urged down onto surface r-s, with its leading edge passing the MICR reader. Assume an in-hopper for feeding up to 100 checks to the auto feeder (operator energizes with START switch, rotating all rolls R—associated pinch rolls biased thereagainst).

Conveniently, all rolls (R-1, -1', -1", -2, -3, etc.) rotate in one direction, yet "flip" checks and re-present them the common imaging station, albeit upside-down. Also, workers will appreciate that M-1 tolerates only a single check at a time (e.g. next check pulled-in from in-hopper only after "current" check exits to a bin—and thus only two related streams of image bits are developed at a time, with no need to "tag" or otherwise correlate bits from Front and Rear sides if a check (a great problem with two-camera systems, operating in parallel). Note: preferably this camera IC detects the arrival and exit of each check-face by optically sensing the relatively-bright check face, vs. a black background provided inside the machine, near the imaging site.

Thus, the camera electronics need only sense the (relatively "white") bit-stream from the front face, then an "all-black" interval after this face passes) and next a second (relatively "white") bit stream from the back face (then "all black" indicates this has passed).

In loop T-oL the check is guided by guide-rails between rolls R-1, R-1', R-1" (e.g. vs. Drum D-1, FIG. 3) after passing the image station the second time, the check is diverted for exit (to bins) by a novel passive, non-powered diverter $G_1$ adapted to pass any check, etc. (However light and flimsy, but only in the exit-direction (i.e. not for incoming checks entering image station).

Figure 1B:
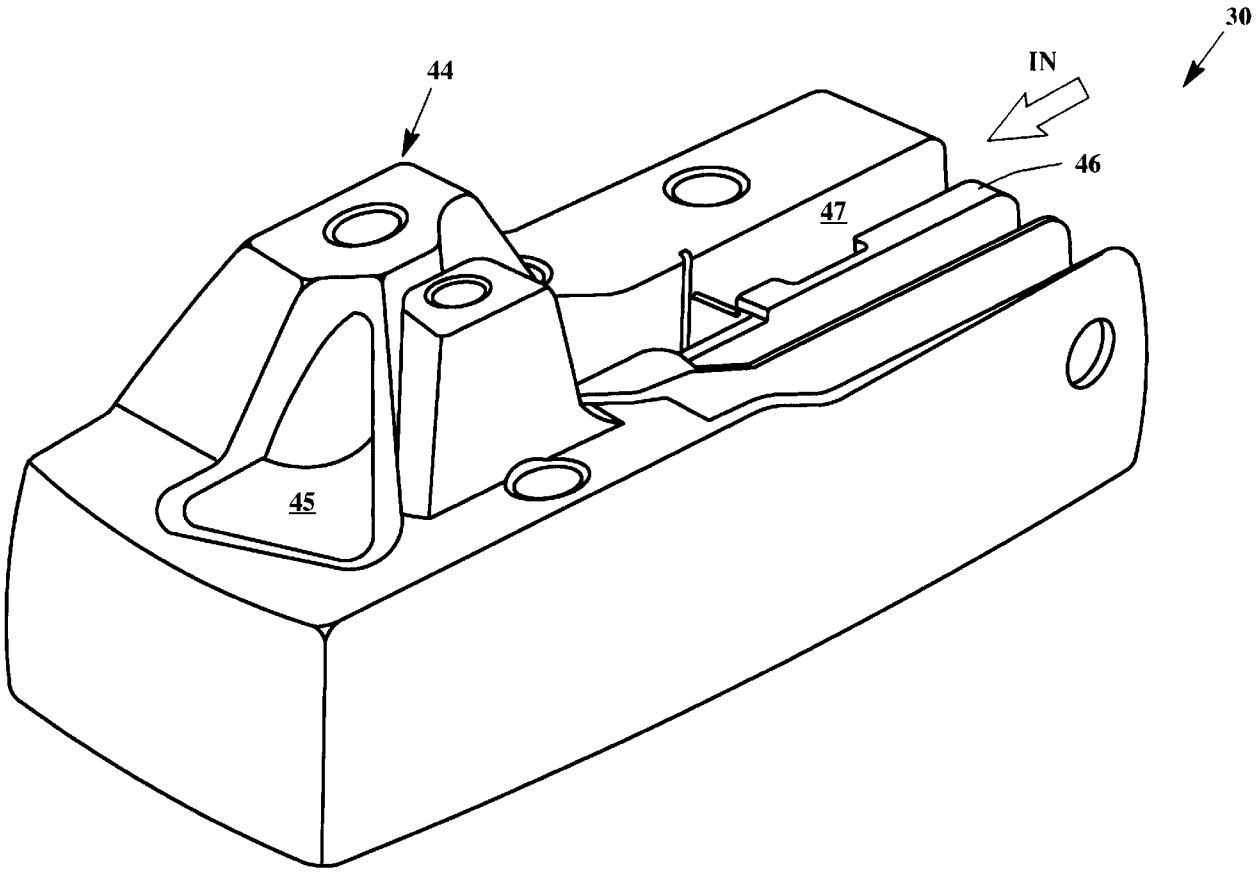

In FIG. 1B, machine M-1 is shown with "skins" on (e.g. see cover for image camera 1C and cover C-T-oL for turn-over-loop T-oL). The pocket at In arrow is an in-hopper H, with a stack-pushing plate, or "flag" H-f.

The foregoing summarizes one concept of a Teller Window Scanner that provides Front and Rear Images using one Camera. It also can provide MICR read and endorsement, with two pocket stacker bins provided.

Salient goals are low cost and small footprint. The footprint shown in FIG. 1 is estimated to be 86 in. 2 (5.9×14.6) with height at 8.5" maximum.

Preferred Operational Steps

A typical operational sequence, for a machine like M-1, FIG. 1 would be as follows:

Input checks: operator stacks checks (e.g. up to 100) in in-hopper (not shown), then activates machine (start switch) so that auto-transport picks successive checks from in-hopper and transports them through M-1, singly, until ejecting a check into a bin—whereupon the machine picks the next check in the hopper and stars its journey through M-1.

For each cycle, each check will be taken automatically to each successive process station: i.e. first to Front Endorser (if that option is invoked), then to MICR-read, then to Front-imaging (illuminated at Is then imaged—on the fly—by camera which digitizes image and creates a Front-face image bit stream, as known in the art; then turned by loop T-oL and its rear face presented up to Rear Endorser, ER, then to image station Is where the camera records Rear-face image bits (easily correlated with associated Front-face image bits already recorded—e.g. since no other check admitted to M-1 until this check is ejected to a sort bin).

After this imaging at Is, passive gate G-1 diverts check for exiting (as noted before) and sends it to sort-gate G-2 which will divert it to either of bins #1 or #2—depending on command from machine control (not shown but known in the art)—e.g. if MICR read identifies check as "on-us" to bin #1, otherwise to bin #2.

This trasnport sequence is non-stop, continuous; with no stopping and no backup.

>then it stops, moves forward for Front imaging (at Is);

>then it continues around "cul-de-sac" drum (rolls R-1, R-1', R-1"), and back upwards for rear endorse (at ER), rear imaging (at Is) and then into a stacker bin.

Cost reduction is by virtue of one camera and associated electronics for both front and rear imaging. The small footprints are achieved in some embodiments by orientation of document movement; from top to bottom and back upwards to stacker bin. The longest track dimension is vertical, resulting in the small footprint as desired for a Teller type machine.

This "Teller Scanner Machine" preferably exhibits the key features of:

a. Bi-functionality: The machine component devices can provide a more timely "Check Truncation" or a "point-of-sale" system.

b. Low cost: Track loop T-oL that allows one camera to do both front and rear imaging; with device layout along track for minimum size and part count.

c. Ergonomics: Small size, easy Operator document input and removal, low acoustic noise, versatile machine orientation (stand up or lie down), small/flexible I/O cabling.

d. Reliability: Inherent reliability from reduced part count.

e. Simple data-handling; e.g. vs. two-camera systems which create two bit-images and process in parallel, needing to identify which Front-image goes with which Rear-image—here, with one-camera gathering both Front and Rear images serially, in one pass, before next check enters, both images are easy to correlate.

Novel Check Processing

The foregoing suggests a new bank check processing system that reduces check processing costs by capturing digital images and codeline data from checks at the earliest possible point; i.e., at the point of first presentation, such as the bank Teller's window or at a retail point of sale—rather than having a Teller perform operations manually, and send checks to a "back room" for further processing (e.g. later imaging and machine sort, etc.).

By capturing a digital image and codeline data very early at the Teller's window or at point of sale, an electronic "picture" of the check is available for immediate transmission to another site for processing such; e.g.: to enable check truncation, amount data entry, account funds verification, correspondent bank exchange, cash management, fraud reduction.

This new bank check processing system calls for a Teller Scanner machine (e.g. as M-1 above) that is capable of such early scanning of checks and providing an electronic "picture" (of both faces).

Purpose

To provide check processing institutions such as banks and point of sale retailers, with a system to accelerate the processing of checks presented for payment. Accelerated check processing allows banks and retailers to reduce check processing costs.

Alternative Configurations

Figure 3:
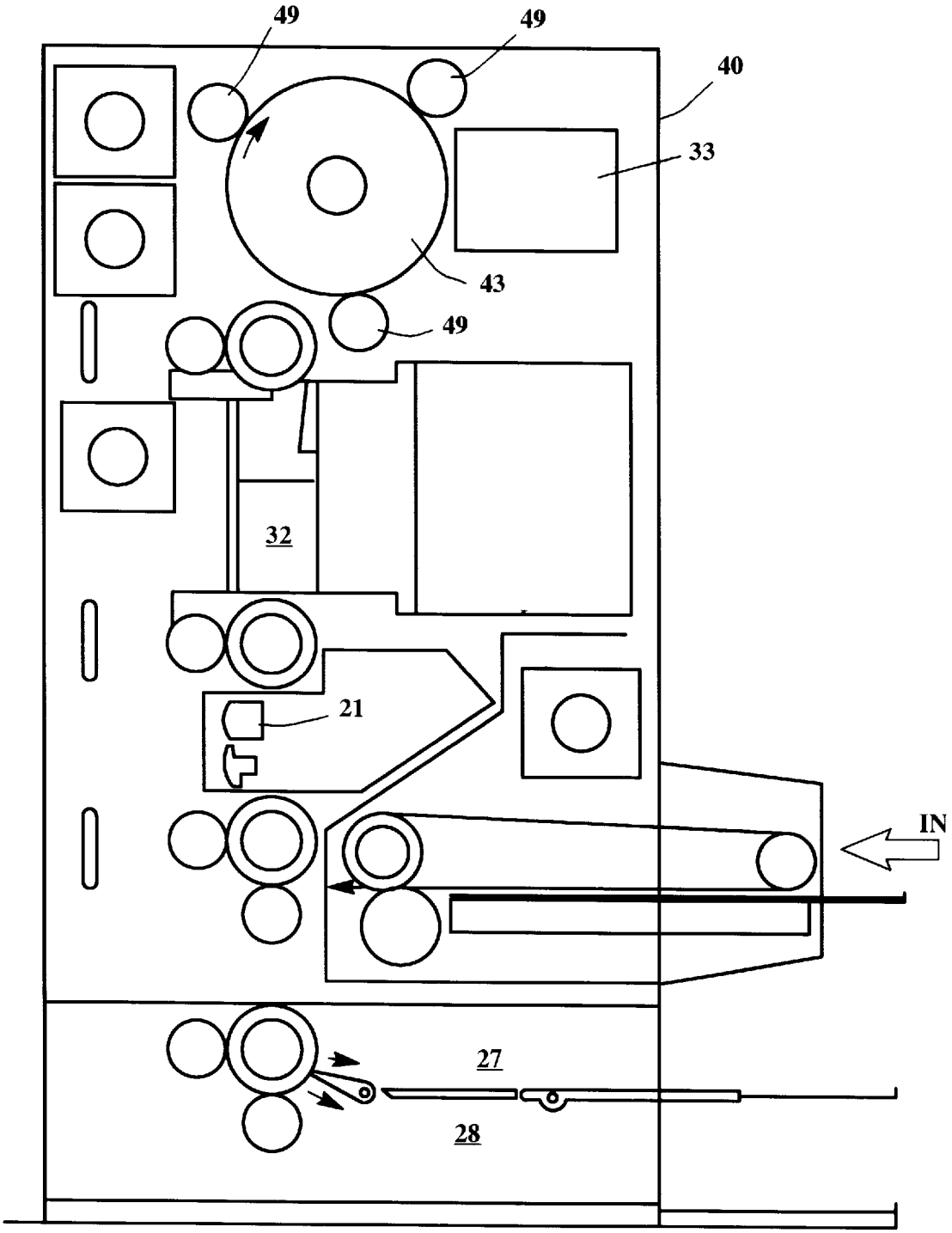
FIG. 3—a comparable layout for an alternate Teller Window Scanner embodiment M-3 with a single turn-around roller (a drum)

FIG. 3 depicts a modified Teller Scan embodiment M-3 which will be understood as generally like M-1 in FIG. 1, except as otherwise noted. Here, each check is transported from entry point (IN) past MICR read and imaging station, then around a drum D-11 in a turn-over-loop, past Endorse station EN to return to the imaging station where check ch presents its opposite face thereto—and finishing the sequence in either of two sort bins.

Figure 3A:
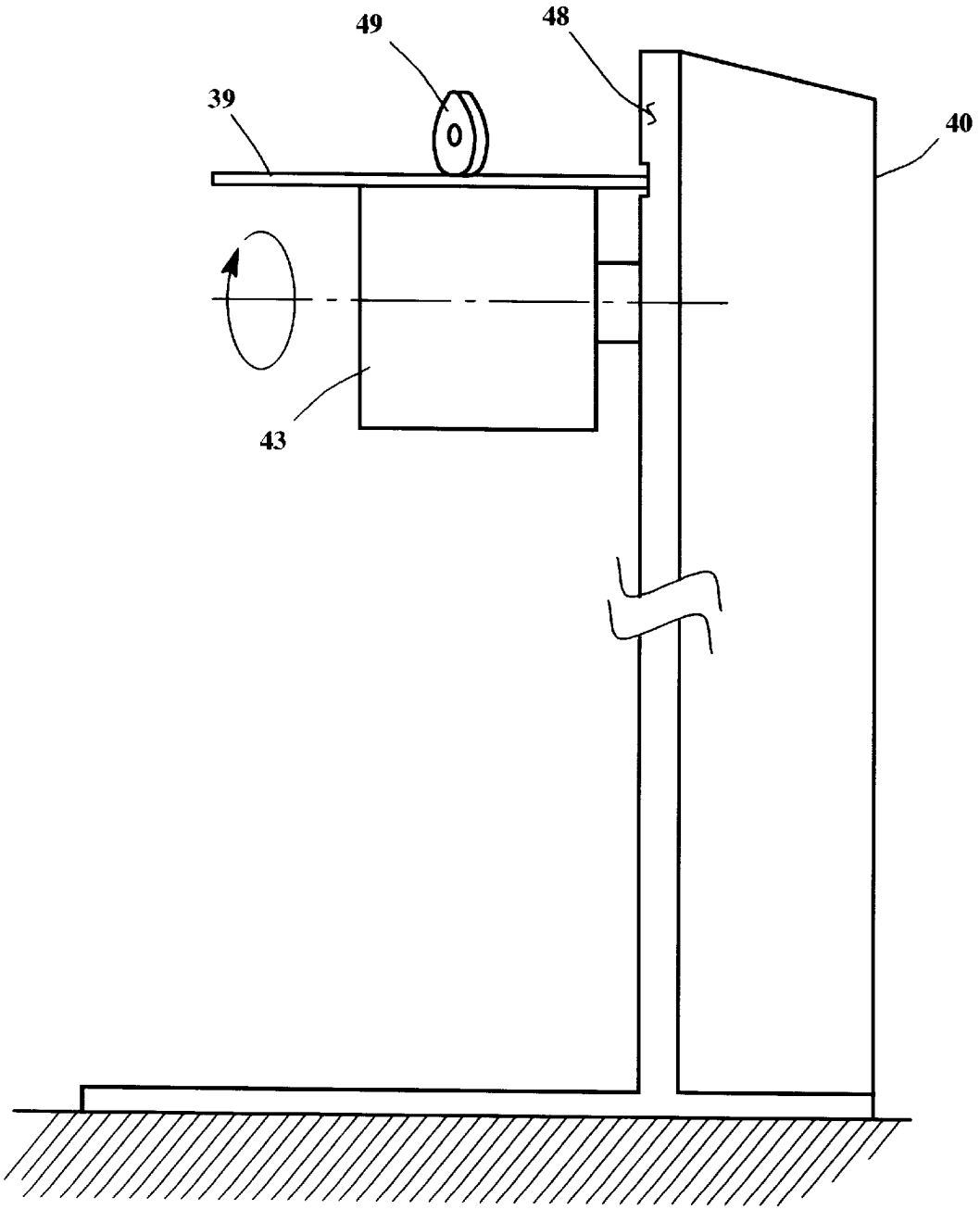
FIG. 3A, an end view thereof.
Figure 3B:
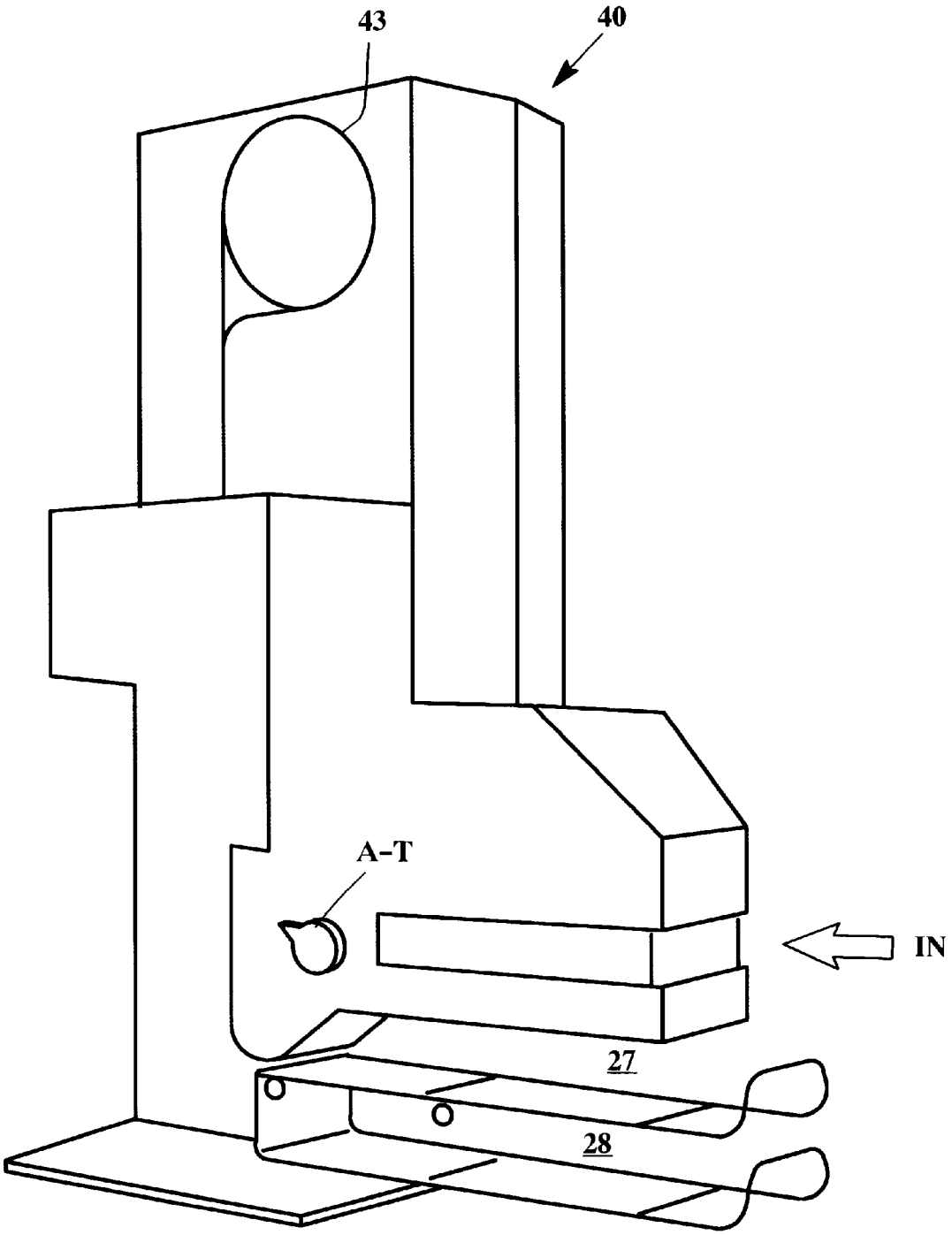
Figure 4:
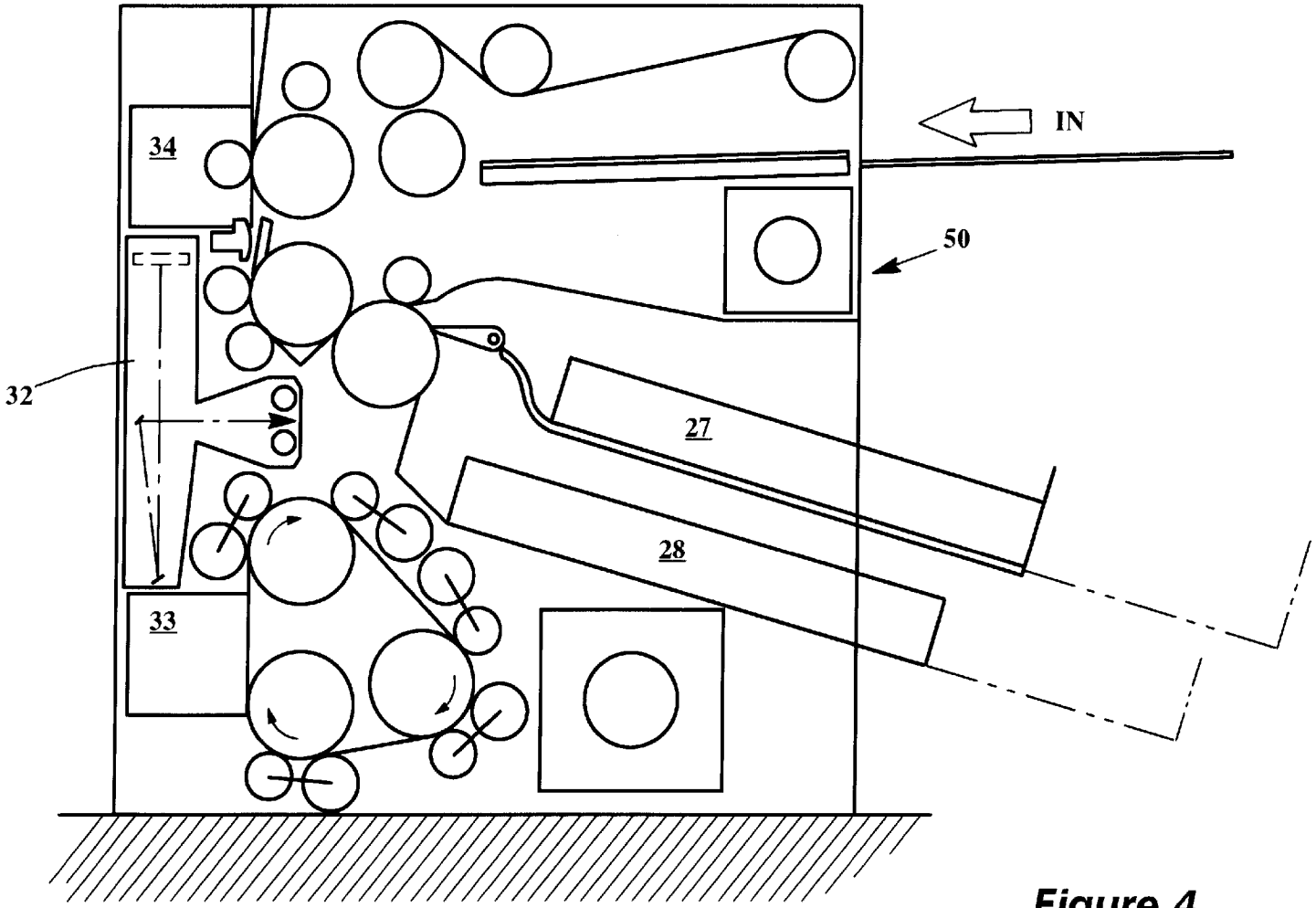
FIG. 4—a comparable layout for another alternate Teller Window Scanner; embodiment M-4 with a right side feeder and bins.

FIG. 3A shows check ch lying horizontally on T-oL drum D-1, with its leading edge urged against a registration surface R-ss (below plane of FIG. 3) by skewed pinch rollers R-sp (e.g. three in FIG. 3 near d-1. FIG. 3-B shows M-3 with skins on);

FIG. 4 shows another embodiment, M-4, more like M-1 (FIG. 1) but reduced in size.

Figure 5:
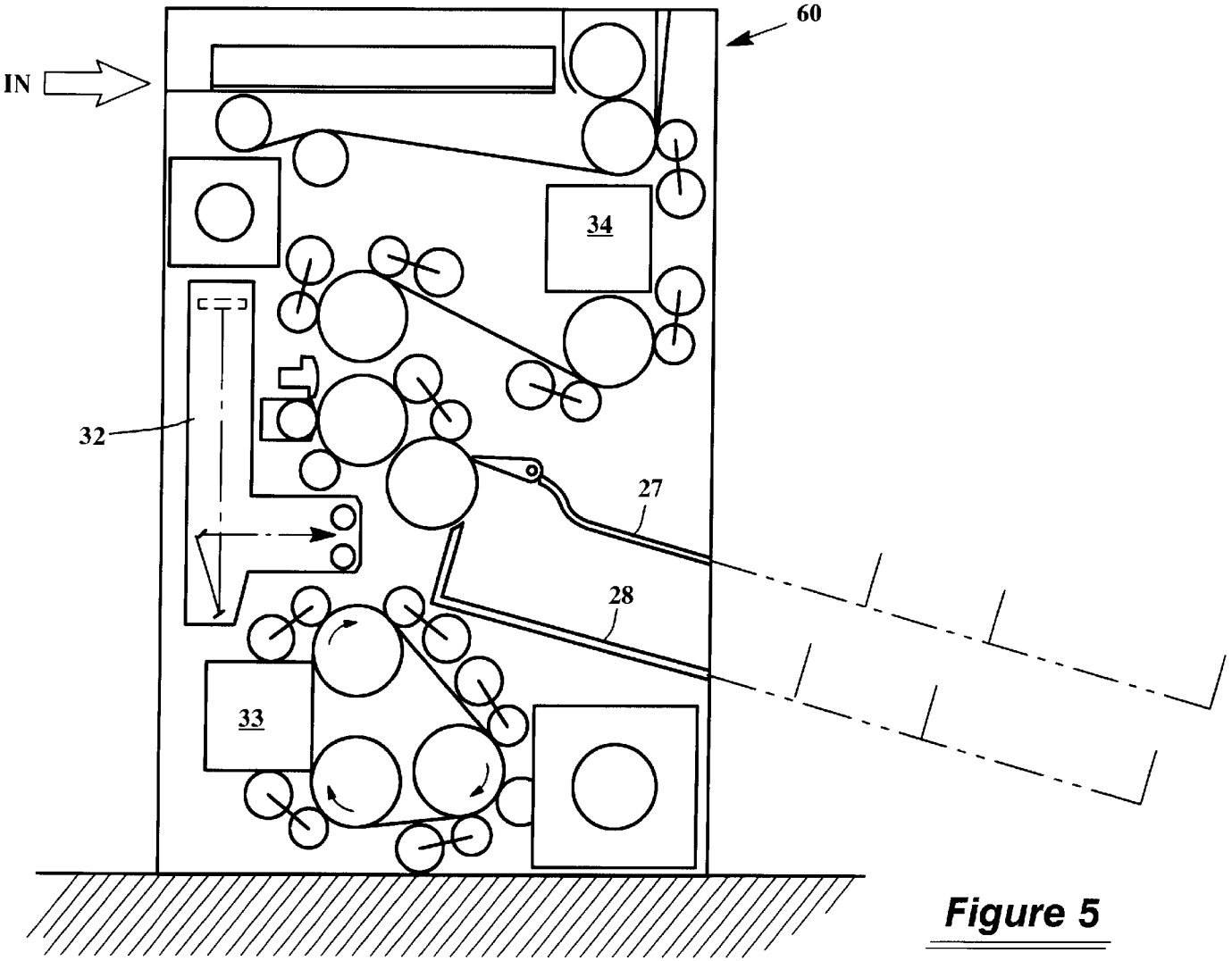
FIG. 5—a comparable layout for another alternate Teller Window Scanner; embodiment M-5 with a top loading feeder.
Figure 6:
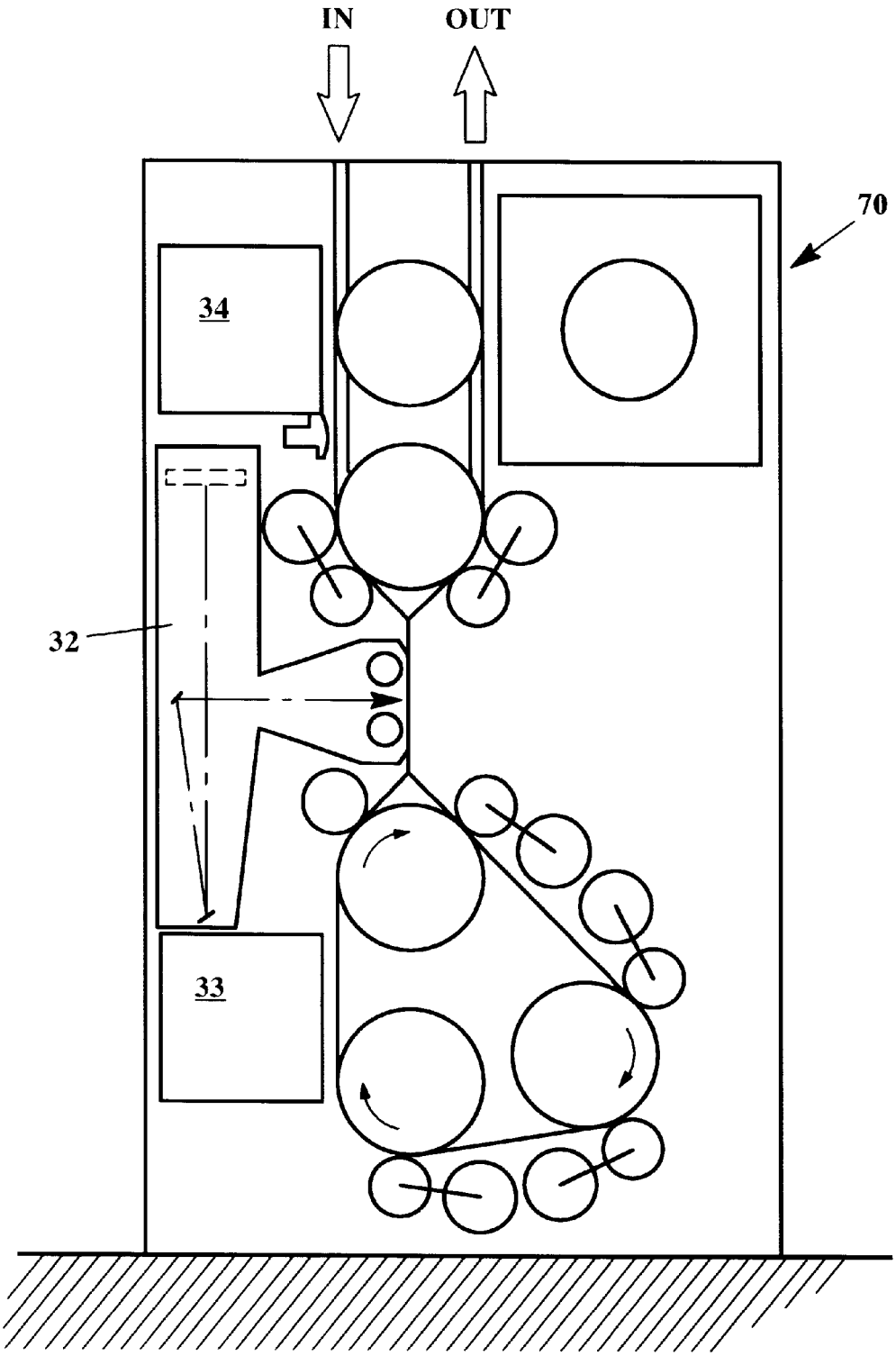
FIG. 6—a comparable layout for another alternate Teller Scanner; embodiment M-6 without a feeder or bins.
Figure 6A:
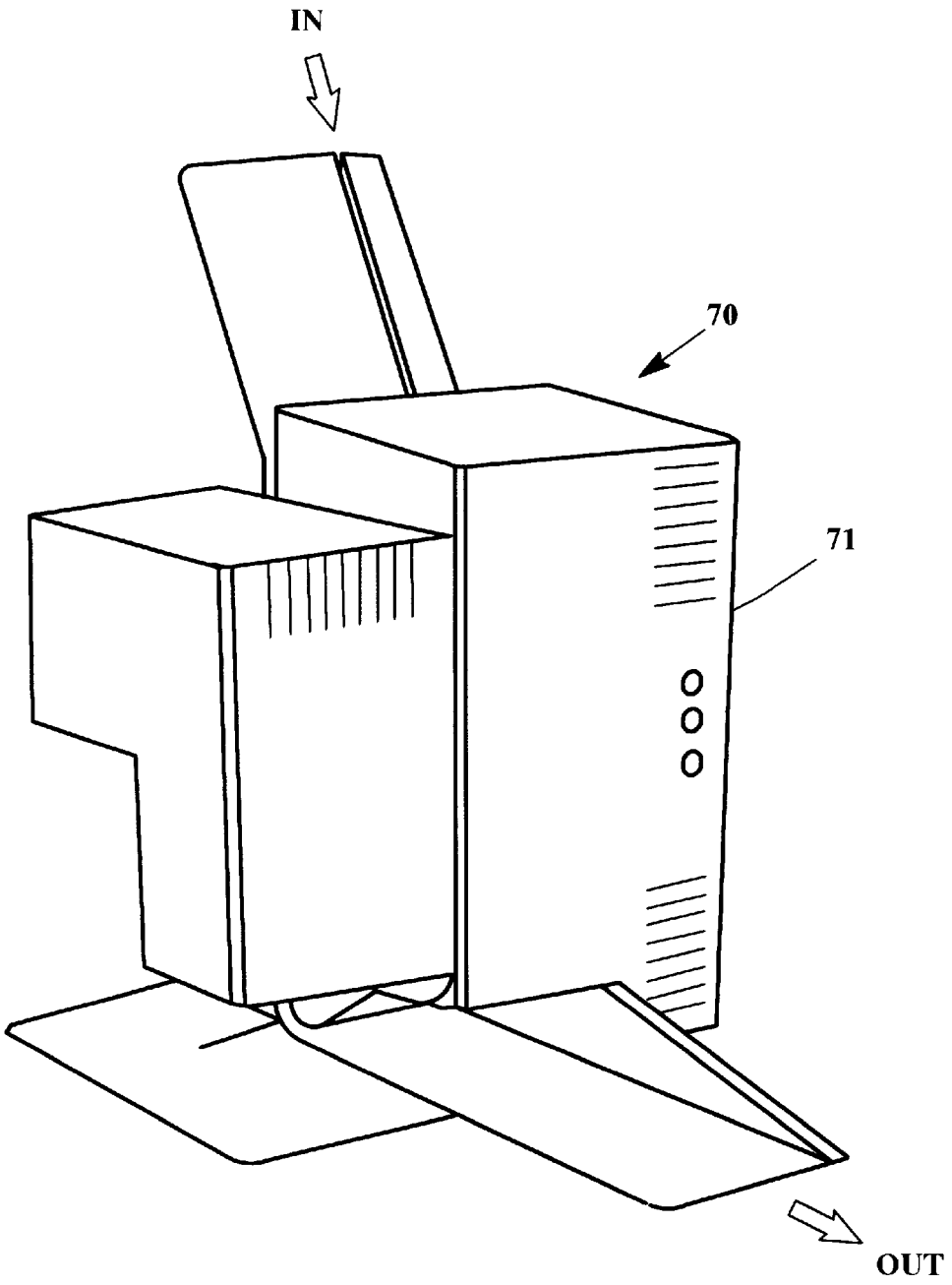
FIG. 6A shows M-6 with skins M-6A. (A more Basic machine but with significant commonality of track layout and components, as with the more fully configured embodiments such as in FIGS. 1, 5 and 4)
Figure 7:
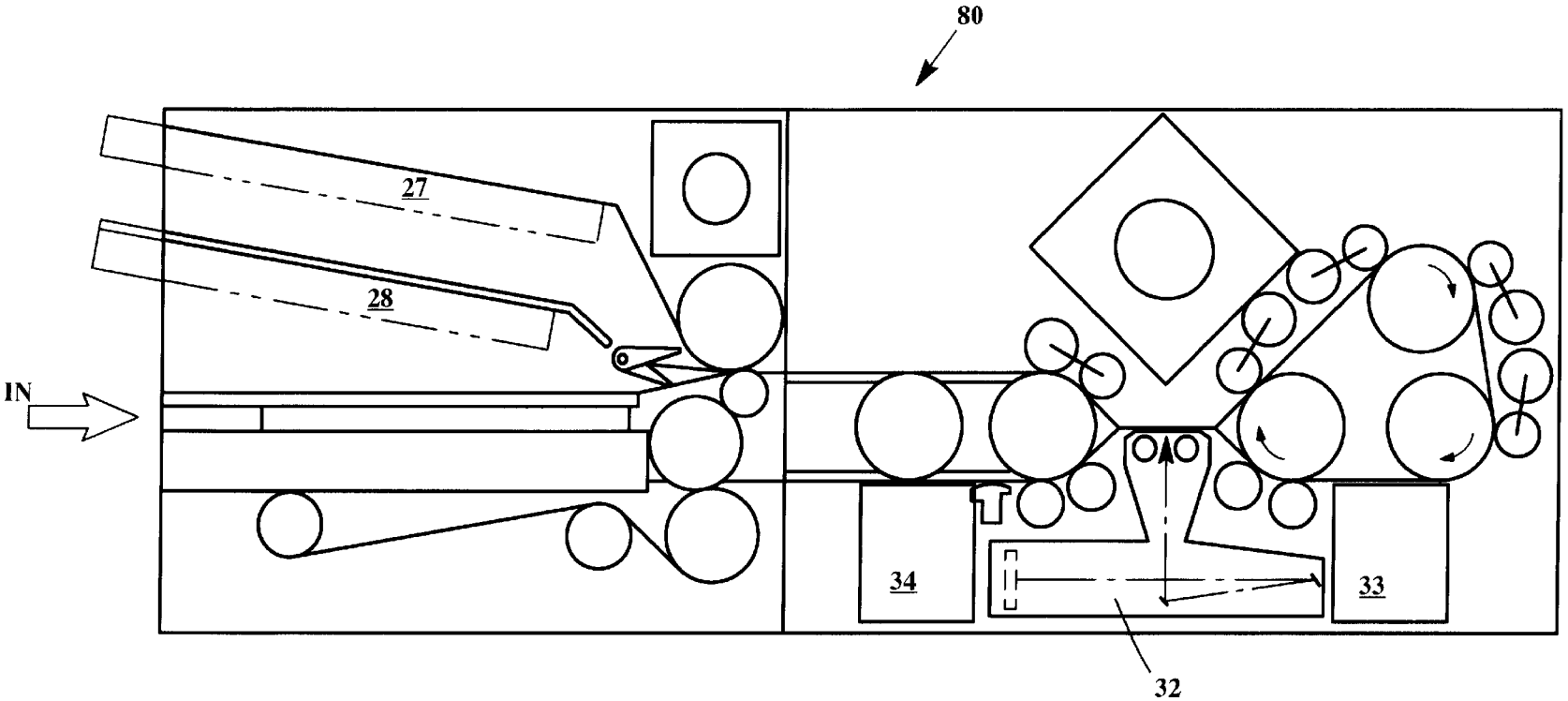
FIG. 7—a comparable layout of another alternate Teller Scanner; embodiment M-7; this embodiment preferably also enhanced as in FIG. 1.
Figure 8A:
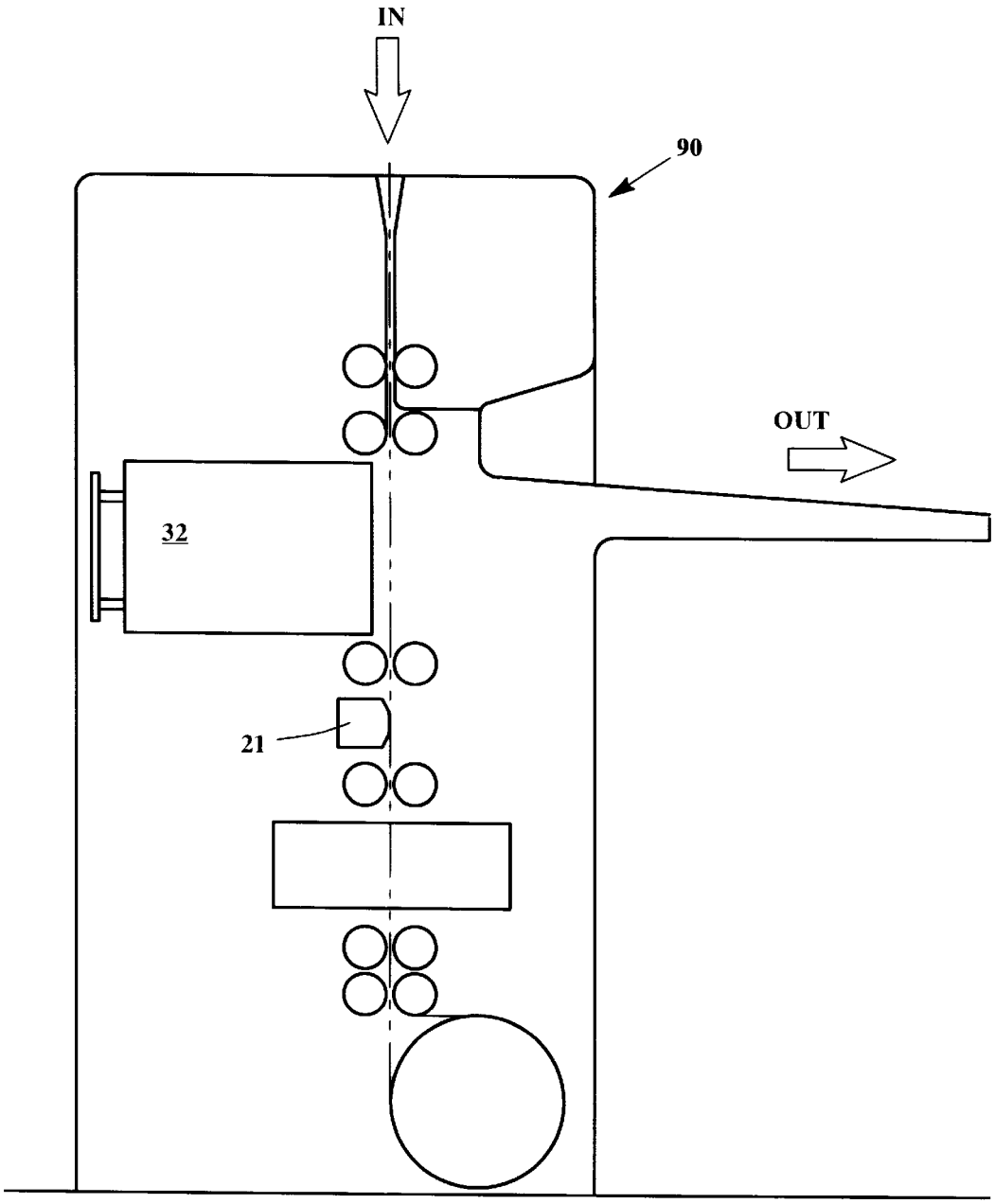
FIGS. 8-A—a comparable layout for another alternate Teller Scanner; embodiment M-8 with; the exterior being shown in FIG. 8-B.
Figure 8B:
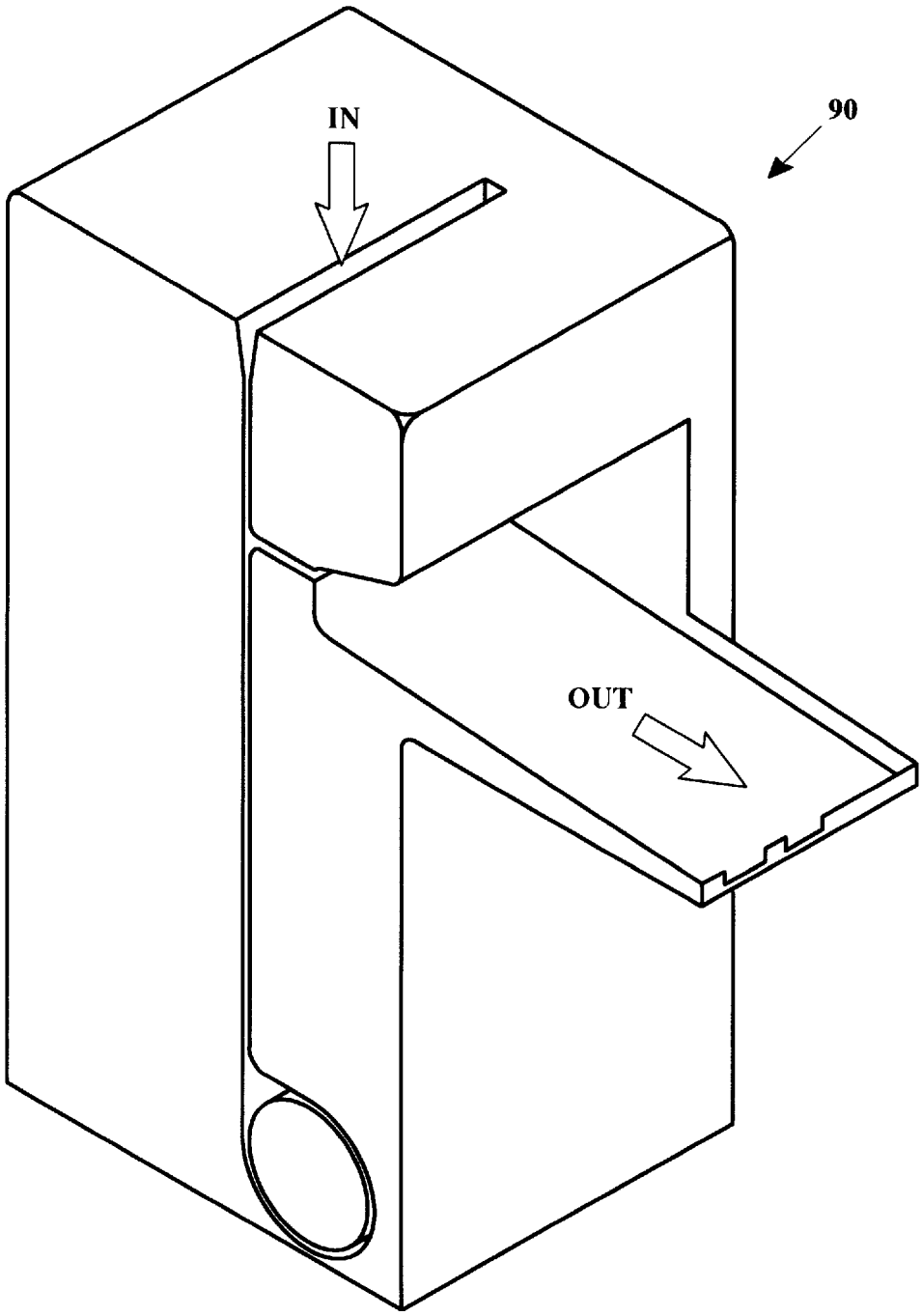
Figure 9:
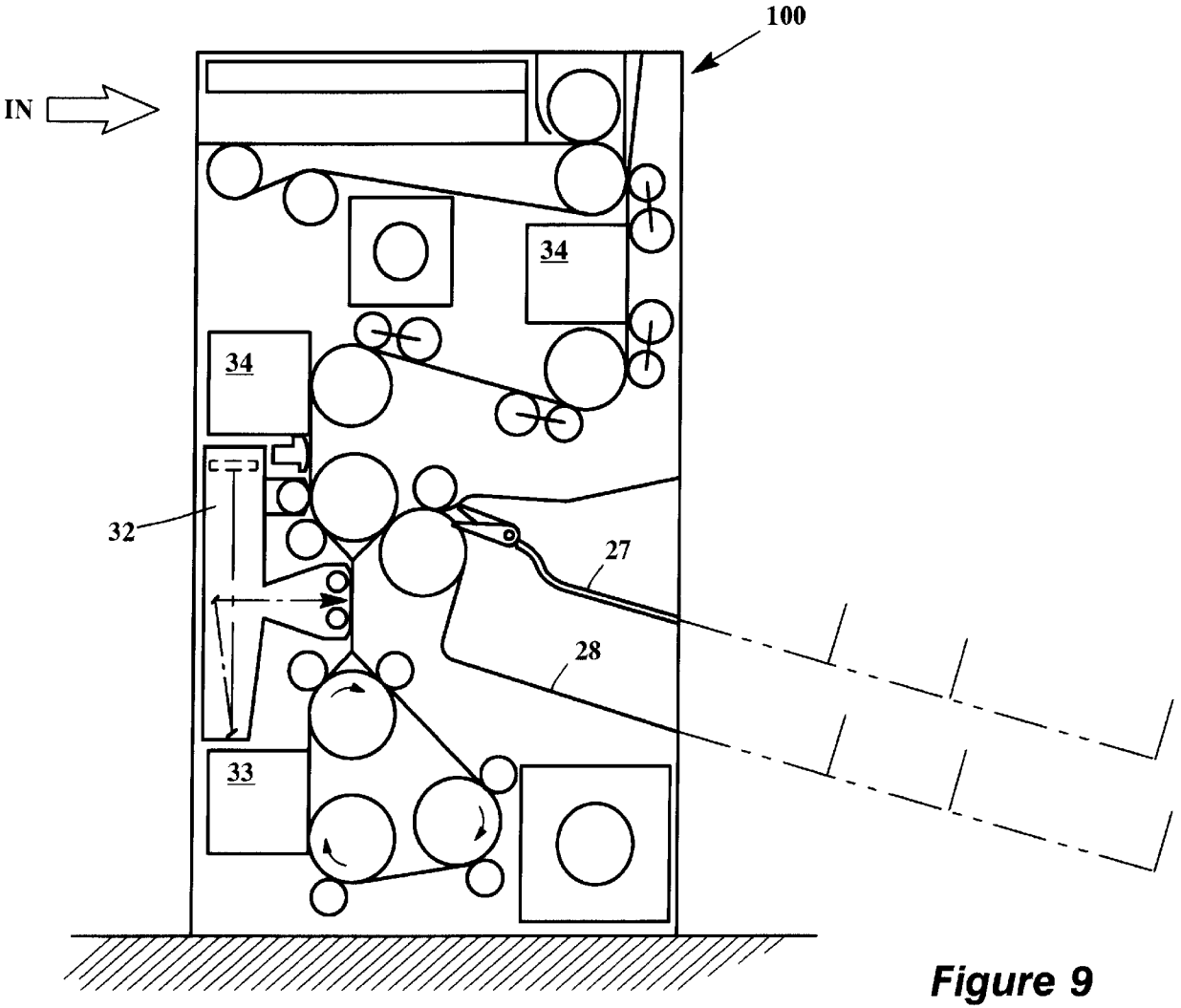
FIG. 9—a comparable layout for another alternate Teller Window Scanner embodiment M-9, similar to M-5 in FIG. 5 but with the addition of a second front endorser.

FIG. 5 shows yet another embodiment, M-5, like M-4 except for being top-loaded and even smaller;

FIG. 6 shows still another embodiment, M-6, like the others, except that it is even smaller and simpler, having no sort bins, and with input entry/output withdrawal being strictly manual (see exterior skins 6-S in FIG. 6A);

FIG. 7 shows yet a further embodiment, M-7 like M-1, but with bins differently located; also check moves vertically, mostly, FIG. 8A shows another embodiment M-8 somewhat like M-3, but locating MICR downstream of camera-imaging site, and ejecting check just after second image pass at gate G-a to expel it along out-path (see dotted line), while FIG. 8-B shows exterior of M-8; and FIG. 9 shows still another embodiment M-9, like M-1 except that it has two Front Endorse stations EF', EF" (for increased print capability).

What Is New

A salient feature of this bank check processing system invention is the capability of earlier rapid processing of checks from an electronic image of the check captured at the "point of first presentation".

Advantages Over Conventional Practice

Conventional practice for bank check processing may typically be as follows:

a. a client presents a bank check to a Bank teller on Day-1;
b. at days end, all checks are collected and physically transported to the Bank's central processing location.
c. near days end, the checks are processed through a document encoding machine to encode the amount field on each check.
d. the checks are then processed through a high speed document processing machine that reads the magnetic or optical characters, scans the front and rear side of the checks and generates a digital image of both sides and prints an endorsement on each check.
e. early the next morning (Day-2) the checks are sorted, grouped and physically shipped to the bank of origin.
f. a check will arrive at the bank of origin the next day or up to several days later. (Day-3+)
g. the Bank of origin will verify that funds are available in the account, credit the bank of first deposit.
h. if the account has insufficient funds or is closed or the check is fraudulent, it is typically "discovered" at this point. (E.g. on Day-3+)

With this invention, an electronic image of the check is captured at the Tellers window and can immediately be transmitted electronically to a processing center or the bank of origin to immediately verify availability of funds and/or truncate further check processing within minutes or hours.

Check processing is simplified and costs are reduced with this invention; e.g.:

a. earlier detection of fraudulent checks or account problems.
b. avoiding truncation delays due to physical check transportation delays.
c. reduced physical check transportation costs.
d. faster funds transfer, posting.

Workers will appreciate that such "Branch capture" of images is especially important for countries that do not clear checks, or do "exception capture" (worldwide), or do upstream image capture (worldwide) for amount data entry.

Resulting Scanner Machine Advantages

Workers will realize that the foregoing novel features allow a Scanner:

to have a footprint no larger than 6" by 12" footprint; to fit on tabletop or shelf in teller cage
to use 200 dpi image font—JPEG 16 level gray scale—transcode capable to CCITT group IV
to operate at (70) personal checks (US) per minute; 3000 checks/day
to connect to PC via standard PC connection (SCSI or other)
to use operator interface for errors, status, program communication
to Meet CE Mark and all other regulatory standards
to exhibit less than <57 dBa noise max. during operation
to support all document specs as DP500-size, weight, grain
to use red filter/red LED for dropout ink for front only
to read MICR magnetically—E13B and CMC7 can't read/mis-read <1% of documents
to use ink jet, single line endorse-printing Optional Software device drivers for WNT
CAPI for inclusion into network
Image compression, image cropping, short term archive, transcode on PC Primary Applications 1) As Teller window image scanner, where teller accepts checks over the counter, images them, captures codeline, can then truncate check, or give ICR GIRO information. (e.g. for German branches)

2) Teller window or bank back office image capture, where image is transmitted off-site for amount data entry, check follows for power encoding later.

3) As Point-of-sale/retail capture for high value items, customer convenience, or bank cash management marketing to reduce fraud, increase collections, and archive.

4) For "return item"/"exception item" capture for Reg CC at a more cost effective price point than is offered today.

5) First check pass at the teller window, can truncate "on-us" items, exchanging items with large correspondent banks, and earlier power encode for Fed/transit items.

Of course, many modifications to the preferred embodiment described previously are possible without departing form the spirit of the present invention. For example, there are many different ways to provide controls as described in the present invention, and it is not limited to the particular types of sensors or the particular types of advance means. As a further example, the control in its preferred embodiment is described as a software algorithm, but it is well known that the same functions can be accomplished using known hardware. Additionally, some features of the present invention can be sued to advantage without the corresponding use of other features.

Accordingly, the description of the preferred embodiment should be to be considered as including all possible modifications and variations coming within the scope of the invention as defined by the appended claims.

What is claimed is:

1. A sheet processing array comprising an imaging station, an in-site and an exit-site plus a transport array connecting all these, wherein said transport array is adapted to advance sheets from said in-site, past said imaging station for imaging of a first sheet face and to advance it therepast with a Reversing Transport Section having a series of roller means arrayed in a loop and continually rotating in one direction adapted to provide non-stop forward movement that turns the sheet over and returns it to present its opposite face to said imaging station for imaging thereof and is further adapted to advance the sheet to said exit-site.

2. The invention of claim 1 also including Front-printing means upstream of said imaging station and Back-printing means disposed downstream thereof and operatively disposed so that said Reversing Transport section operates re-entrantly to present the opposite face of a said sheet to said imaging station.

3. The invention of claim 1 where said Reversing Transport section comprises a belt-loop and cooperating external rollers.

4. The invention of claim 1 where said Transport array is adapted to present said first face to be imaged at said imaging station, and said Reversing Transport section is adapted to present the opposite face thereto, while advancing it re-entrantly in the opposite direction.

5. The invention of claim 4 including a first endorse station upstream of said imaging station and a second endorse station downstream thereof, along said Reversing Transport section.

6. The invention of claim 5 wherein common unidirectional roll means are arranged to inject said sheets to said imaging station, and to also eject them therefrom.

7. The invention of claim 5, wherein common roll means is arranged to inject said sheets into said Reversing section and also to inject said sheets past said image station in a second, reverse-pass.

8. The invention of claim 5, wherein said exit-site leads to N store-bins and includes gate means adapted to direct a sheet to a selected bin.

9. The invention of claim 5, also including a Read station.

10. The invention of claim 9, where said Read station is adapted for MICR reading of said first face.

11. A sheet handling machine comprising a single imaging station, an In site and an Exit site, plus sheet transport means adapted to advance like sheets singly from said In-site, past said imaging station, while presenting a first sheet face of each sheet thereto for imaging thereof plus sheet turn-over means having a series of roller means arrayed in a loop and continually rotating in one direction to provide non-stop forward movement to said sheet and adapted to remove each sheet from said imaging station, then turn it over and return it thereto with its opposite face presented thereto for imaging, plus exit-transport means for, thereafter, removing the sheet from said imaging station and advancing it to said exit site.

* * * * *